US006929209B2

(12) United States Patent
Baumgarten

(10) Patent No.: US 6,929,209 B2
(45) Date of Patent: Aug. 16, 2005

(54) SELF-ORIENTING RETRACTABLE ID CARD HOLDER

(76) Inventor: David Baumgarten, 144 Ottley Dr., Atlanta, GA (US) 30324

( * ) Notice: Subject to any disclaimer, the term of this patent is extended or adjusted under 35 U.S.C. 154(b) by 0 days.

(21) Appl. No.: 10/620,220

(22) Filed: Jul. 14, 2003

(65) Prior Publication Data

US 2005/0011981 A1 Jan. 20, 2005

(51) Int. Cl.[7] ..... B65H 75/48
(52) U.S. Cl. ..... 242/377; 242/379; 40/1.5
(58) Field of Search ..... 242/377, 379, 242/379.2; 40/1.5

(56) References Cited

U.S. PATENT DOCUMENTS 2,250,171 A * 7/1941 Wilkins ..... 242/377
2,616,635 A * 11/1952 Carlson ..... 242/377
2,800,289 A * 7/1957 Stamm ..... 242/377
3,424,422 A * 1/1969 Klangos ..... 242/379.2
5,699,975 A * 12/1997 Paugh et al. ..... 242/371
6,212,741 B1 * 4/2001 Cahill ..... 24/298
6,364,237 B1 * 4/2002 Kagel ..... 242/379
2002/0104914 A1 * 8/2002 Rankin ..... 242/379
2003/0132132 A1 * 7/2003 Small ..... 206/449

* cited by examiner

*Primary Examiner*—John M. Jillions
(74) *Attorney, Agent, or Firm*—David Dolberg, Esq.

(57) ABSTRACT

Disclosed is an automatically retracting cardholder or accessory holder which, when worn, retains and automatically reestablishes the desired orientation of the card or accessory to user. A longitudinally flexible tape is used, with a non-circular cross-sectional geometry having a long and short axis and lateral stiffness. The tape passes through an orifice in the housing that geometrically corresponds to the shape of the tape, thereby obviating the tape from passively rotating about its long axis, or, due to the inherent memory of the long axis rotation of the tape, automatically reestablishing the desired orientation of the tape rotation if the tape is twisted by the user. The means for attaching the card or other accessory to the tape is such that the orientation of the accessory to the tape is fixed. Thus, the orientation of the card or accessory to the housing, and consequently the user wearing the housing, is fixed thereby.

6 Claims, 5 Drawing Sheets

SELF-ORIENTING RETRACTABLE ID CARD HOLDER

FIELD OF THE INVENTION

The invention relates generally to an accessory or identification card holding device. More specifically, it relates to a spring-loaded, retractable accessory or ID card holder worn by the user.

BACKGROUND OF THE INVENTION

Retractable devices for holding cards, keys and other objects are well known. For instance, several U.S. Patents describe key holding devices. See, for example, Paugh U.S. Pat. No. 5,833,165 and U.S. Pat. No. 6,073,875. Others disclose devices for holding golf-related accessories. See, for example Johnson U.S. Pat. No. 5,230,117, Moultrie U.S. Pat. No. 5,555,589, Jones U.S. Pat. No. 5,815,873, McGee U.S. Pat. No. 5,864,925, and Halloran U.S. Pat. No. 6,112,357. Still others disclose a device for holding a cellular phone, Poulson U.S. Pat. No. 5,938,137 and other accessories Salentine U.S. Pat. No. 5,697,572, Shih U.S. Pat. No. 5,954,288.

Generally, such devices include a housing containing an extendable/retractable circular string, cable or cord, attached to a spring mechanism which loads when the cord is extracted and relaxes when the cord is released, thereby retracting the cord. Typically, a thin round cord is used because this is the simplest geometry for spooling within the housing. The particular accessory, such as an identification or security access card, keys, small tools and the like, is attached to the end of the cable cord. Such devices provide a convenient method for keeping accessories attached to the user even while the accessory is useable at some extended distance.

This technology has been used with personal identification and security access cards. Frequently, companies require employees to always carry their card and the card is used several times during the work day to inform automatic card readers of desired access to secured areas. Typically, the card is attached to a retractable cord. When worn, the card has a tendency to flap and spin about the axis of the cord as the wearer moves about—particularly in a windy environment.

SUMMARY OF THE INVENTION

The instant invention relates to an automatically retracting cardholder or accessory holder which, when worn, retains and automatically reestablishes the desired orientation of the card or accessory to user. This is accomplished by using a longitudinally flexible tape with lateral stiffness and some ability to be twisted about the long axis, but with a return memory such that the passive orientation of the face of the card to the tape and housing face is maintained. Alternatively, a longitudinally flexible cord may be used, with a non-circular cross-sectional geometry having a long and short axis and lateral stiffness. The tape (or cord) passes through an orifice in the housing that geometrically corresponds to the shape of the tape, thereby obviating the tape from passively rotating about its long axis, or, due to the inherent memory of the long axis rotation of the tape, automatically reestablishing the desired orientation of the tape rotation if the tape is twisted by the user. The means for attaching the card or other accessory to the tape is such that the orientation of the accessory to the tape is fixed. Thus, the orientation of the card or accessory to the housing, and consequently the user wearing the housing, is fixed thereby.

It is an object of this invention to provide an automatically retracting card or accessory holder that can be worn by a user.

It is an object of this invention to provide a card holder with an extendible and retractable tape wherein the tape orientation to its housing is fixed about its long axis.

It is an object of this invention to provide a card holder that passively retains and automatically reestablishes the orientation of the card to the wearer of the card holder.

It is an object of this invention to provide a card holder that will allow the user to move the card or accessory by hand as necessary, but will reestablish the preferred orientation upon retraction of the accessory.

It is an object of this invention to provide a card holder that is worn on the side of the user and orients the card flush to the user's side.

In accordance with the above objects and others described herein, a self-orienting retractable ID card holder is provided, comprising a housing with a circular cavity, a broad-faced top and bottom and a side having a tape-orienting slot. A longitudinally flexible and laterally stiff tape is coiled within the cavity and passes through the slot in the side of the housing. The tape has a central end affixed within the housing and a peripheral end external to the housing. The tape has a cross-sectional long and short axis and is dimensioned to pass closely and snugly through the slot. A card holding means which maintains a fixed orientation of the card to the tape is affixed to the peripheral end of the tape. The card holder additionally comprises a coil spring with a first end affixed to the housing and a second end affixed to the tape such that the spring loads when the tape is withdrawn from the housing and dissipates as the tape withdraws into the housing.

DETAILED DESCRIPTION OF THE INVENTION

Figure 1:
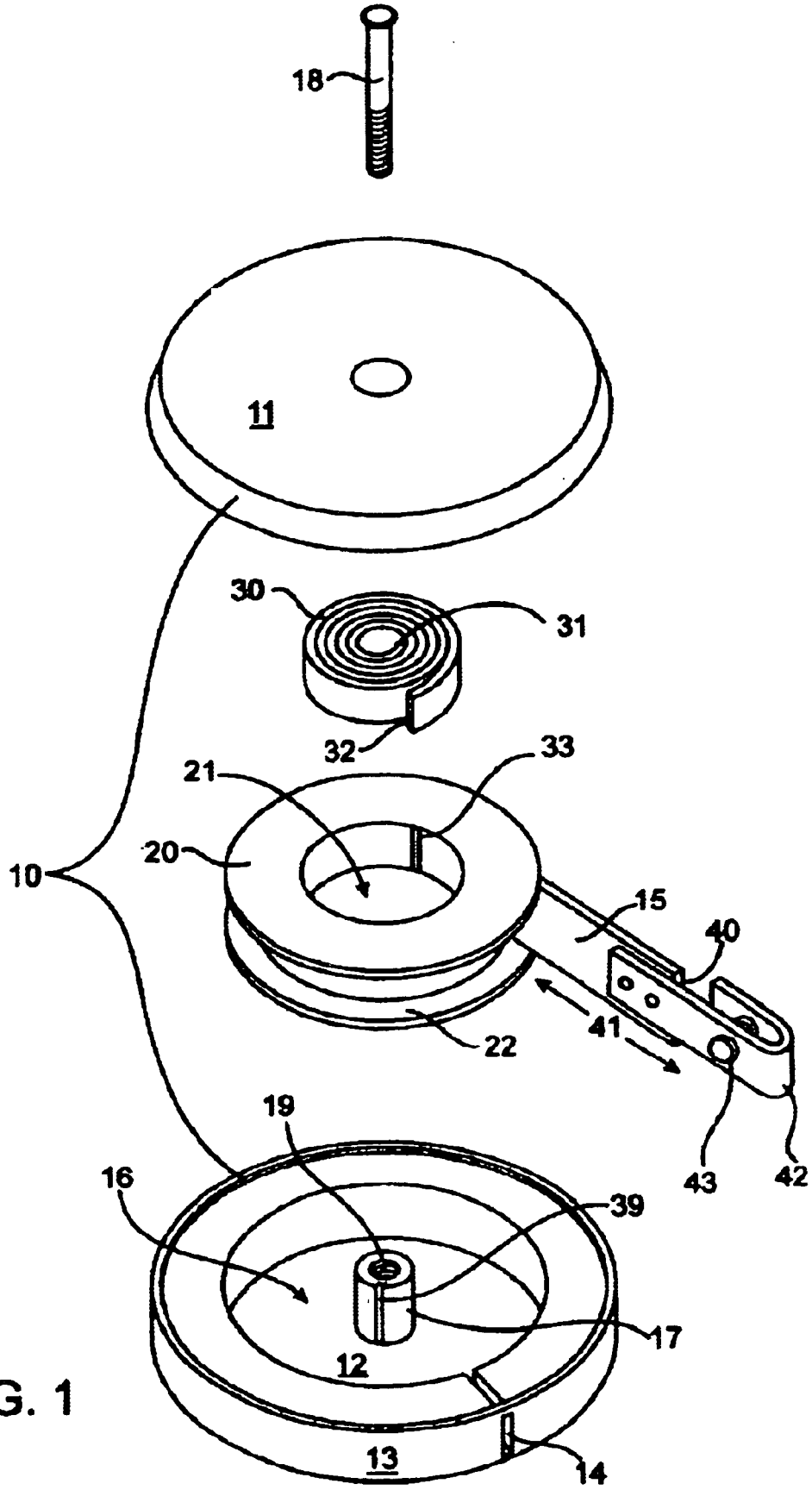
FIG. 1 shows an expanded view of an embodiment of the card holder.
Figure 2:
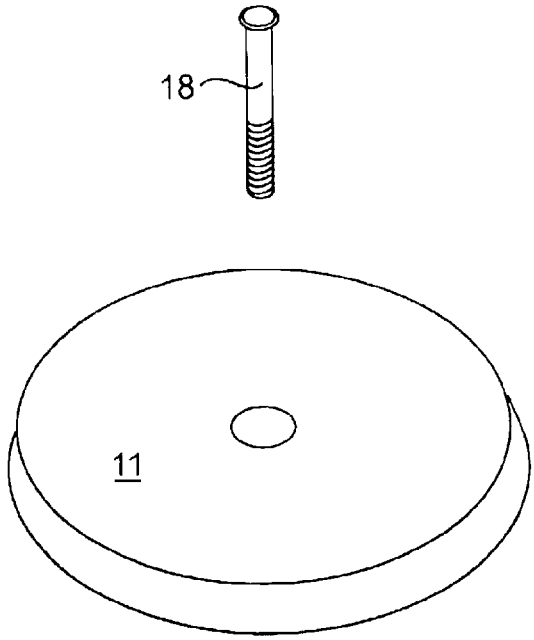
FIG. 2 shows an expanded view of another embodiment of the card holder.
Figure 2:
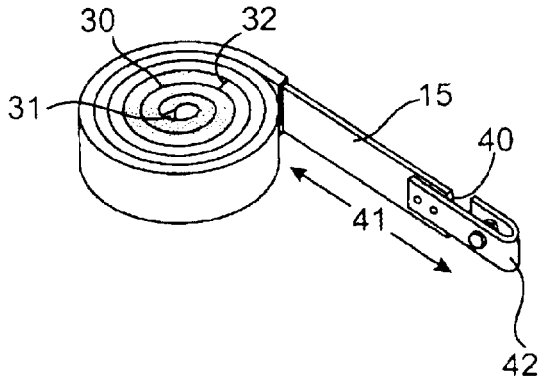
Figure 2:
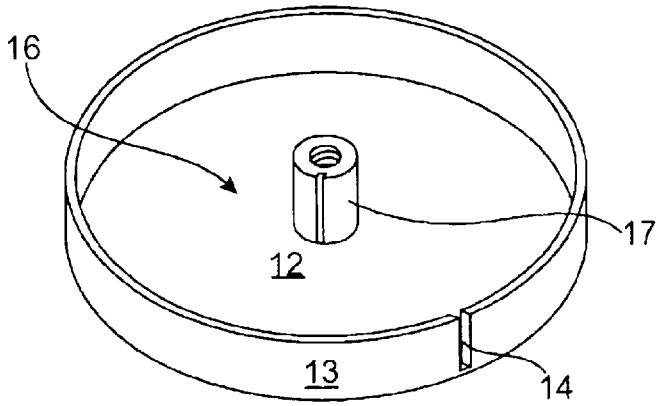

Referring to the drawings, FIG. 1 shows a self-orienting, retractable cardholder with a housing (10) having an openable top (11), a bottom (12) and a side (13). The side (13) has a slot (14), running from the top (11) toward the bottom (12), for receiving a flexible tape (15). The slot (14) can be four-sided as shown in FIG. 1, or three-side and open at the top to allow easy assembly of the tape (15) as shown in FIG. 2. The housing (10) has a circular cavity (16) with a central stem (17) which has a threaded vertical core (19) adapted to receive a screw (18) which passes through the top (11) and serves to fasten the top and bottom of the housing. The housing is designed to accept a circular spool (20) with a hollow core (21) and a circumfrencial track (22). The tape (15) is substantially rectangular when viewed in cross section. The broader sides of the tape are referred to herein as the face of the tape and the narrower sides as the edge. A first end of the tape (15) firmly attaches to the spool track, spools about the spool (20) and passes through the housing slot (14). The hollow core (21) is adapted to receive a coiled spring (30). The inner end (31) of the spring (30) is attached to a vertical receiving groove 39 on the outer side of the threaded stem (17). The outer end (32) of the spring is attached to a second vertical receiving groove (33) on the inner side of the spool (20). Thus, when the tape (15) is withdrawn from the assembled housing (10) the spring (30) loads and automatically retracts the tape (15) onto the spool (20) when the tape is released. Many other means for attaching the spring (30) to the housing (10) (e.g. passing the spring through the spool and attaching it to the track) and spool (20) (e.g., passing the spring through the stem and wrapping it around the stem) are commonly known in the art and are hereby incorporated herein. The outer end (40) of the tape (15) is thickened to act as a limiting stop at the slot (14) of the housing (10) during the retraction of the tape (15). The outer end (40) is also fitted with a means for holding an accessory or card (42). In an embodiment, the means for holding a card serves as the stop (as shown). Commonly, the means for holding an accessory is a strip of plastic or metal (42) which can be folded upon itself and has a snap (43) for creating a openable loop. The strip (42) may be firmly attached to the tape (15) as shown in FIG. 1. Alternatively, it can be pinned to the tape at a single point, in which case the strip (42) might be free to rotate about the pin, but would still maintain the orientation of the face of the card to the face of the tape. It is an essential feature of the invention however, that the means for holding an accessory is attached such that it does not freely turn about the long axis (41) of the tape.

The housing (10) is typically made of a hard plastic, but could be metal. The plane of the broad sides of the top (11) and bottom (12) are referred to herein as the face of the housing. The top (11) and bottom (12) is typically assembled by means of a screw (18) as described. However, other means for assembly, such as a central snap, or peripheral clips are well known in art and are incorporated into other embodiments of the invention.

The coiled spring (30) is made of metal, usually steel or aluminum. For use with identification cards, the retention force is typically less than 0.5 pounds at a two foot extension; however, the force can be increased, if required for heavier accessories, by using a thicker metal for the spring.

The tape (15) is made of plastic, extruded aluminum or other durable material which is longitudinally flexible such that the tape can easily be wound upon the spool (20), and is also laterally stiff and rigid. Furthermore, rotation of the tape (15) about its long axis (41) is resisted and the inherent memory of the tape material is such that, any rotation about the long axis (41) induced by the user during use will automatically be eliminated upon release of the tape. These properties are essential to maintaining the desired fixed orientation of the card or accessory at the end of the tape (40) to the tape (15) and of the tape to the housing (10). Typically the tape is rectangular in cross section., however other shapes can be used in other embodiments. For instance, the tape can be slightly convex or concave, or the tape can be oblong or oval. The essential feature is that the tape is not round and that the tape-orienting slot (14) is contoured to snugly fit the cross-sectional shape of the tape. This feature ensures the fixed relationship of the plane of the tape (15) to the housing (10).

Other means for holding a card are well known. For instance, the male or female portion of a snap can be incorporated into the peripheral end (40) of the tape (15). the complementary portion is incorporated into the card or accessory. Alternatively the card holding means is a rigid J-hook shape that passes through a hole in the card.

In FIG. 2, another embodiment is illustrated, in which the spool (20) of FIG. 1 has been eliminated. Here, the outer end (32) of the spring (30) is firmly attached directly to the tape (15). The inner end (31) of the spring is attached to a vertical receiving groove (32) on the outer side of the threaded stem (17) as in FIG. 1 above.

Figure 4A:
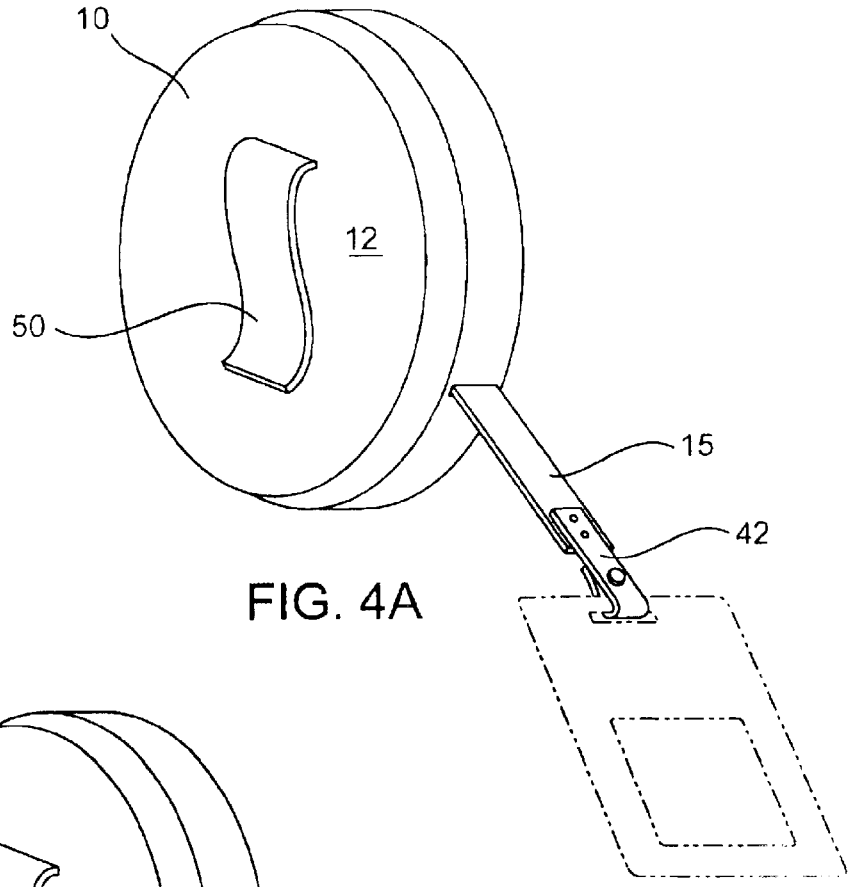
FIG. 4A–C shows perspective views of several embodiments of the card holder.

In FIG. 4A, the assembled inventions, described above, are shown. A belt clip (50) is shown on the outer bottom side (12) of the housing (10). Other means for attaching the invention to the user, such as safety pin, belt loop, various pinching clips and the like are commonly known and incorporated herein.

Figure 3:
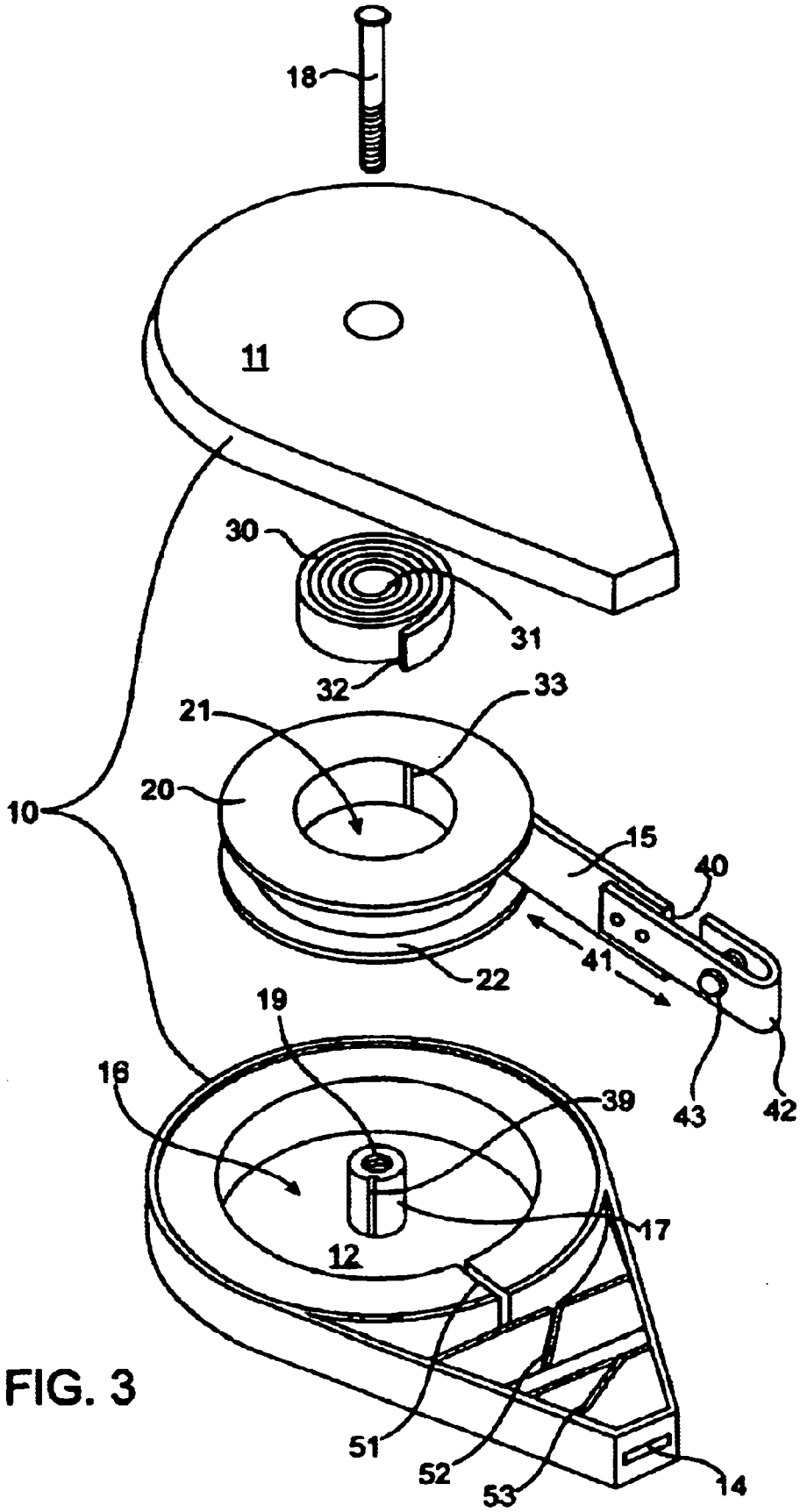
FIG. 3 shows an expanded view of another embodiment of the card holder.
Figure 4B:
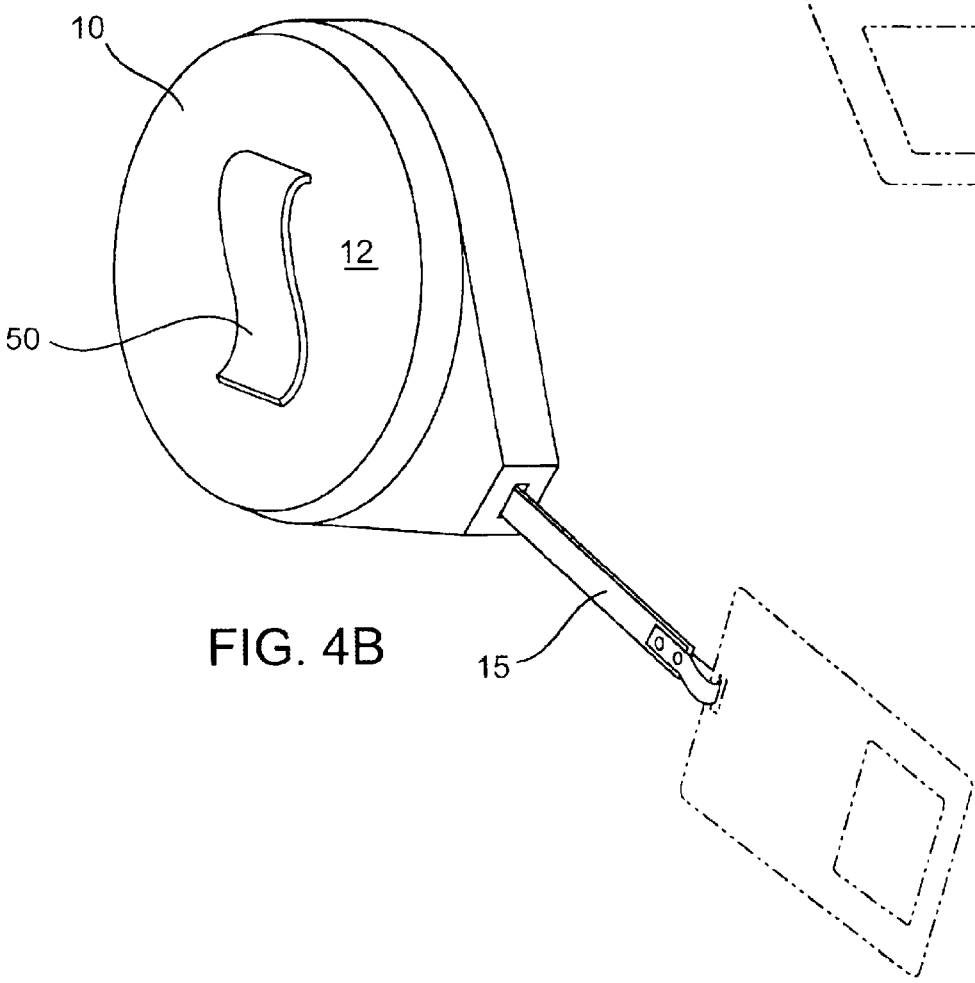

In a preferred embodiment, the card holder is designed to be worn on the side of a user, e.g. clipped on the user's belt. Here, the desirable orientation of the card is flush to the user's side, in which case the preferred orientation of the plane of the flat side of the card is in alignment with the face of the tape housing. This can be accomplished in several ways. FIG. 3 shows the housing (10) incorporating a series of slits (51–53) preceding the exit slot (14) which, in this embodiment, orients the face of the tape substantially parallel to the face of the housing. The slits guide the tape (15) through a 90 degree turn. This embodiment requires no modification of the card holding means (42) at the end of the tape 15 shown in FIGS. 1 and 2 in order to accomplish the parallel orientations of the tape face and the housing face. The assembled invention of FIG. 3 is shown in FIG. 4B.

Figure 4C:
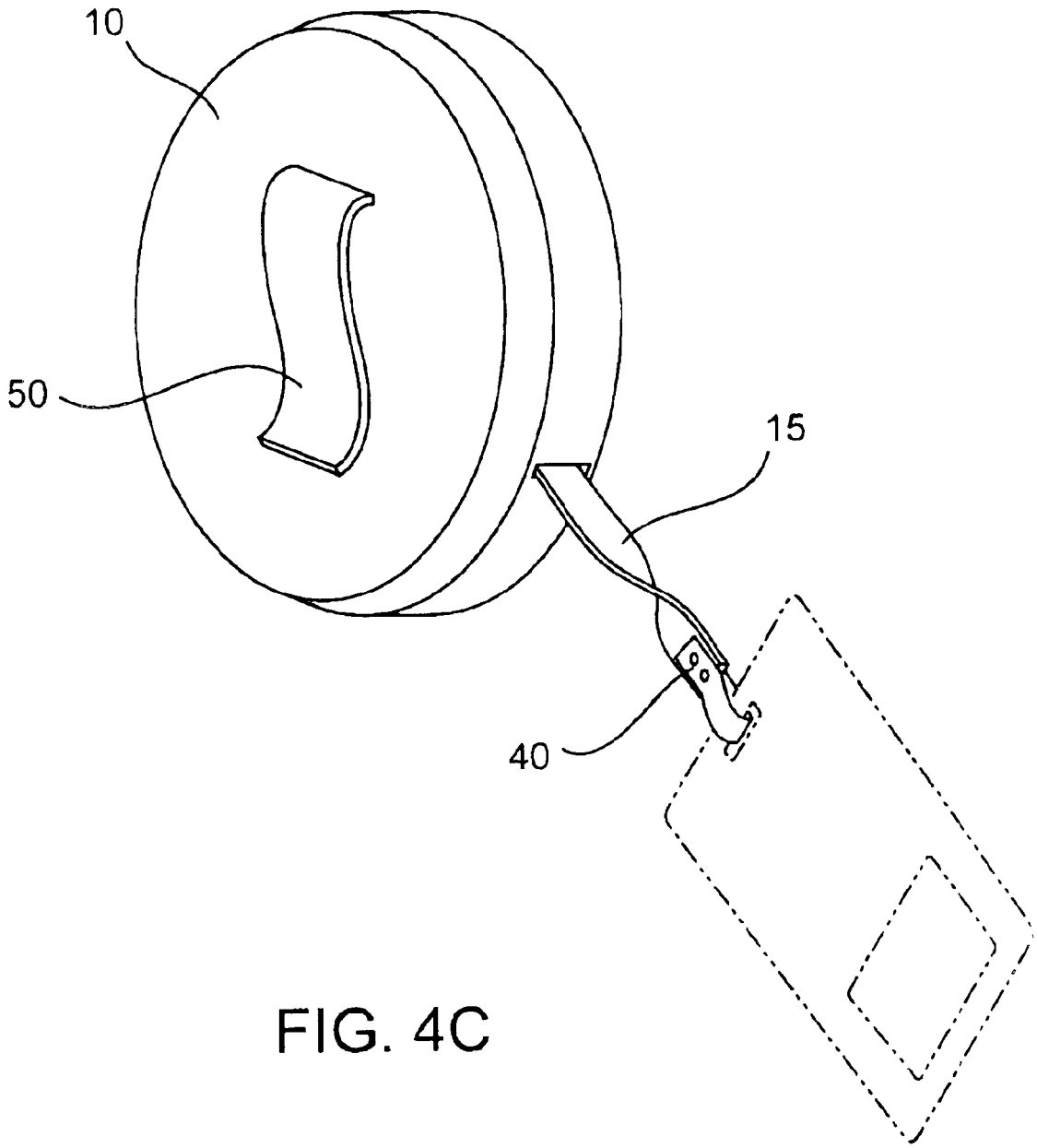

FIG. 4C shows an embodiment of the card holder in which the peripheral end (40) of the tape (15) is fabricated to incorporate a 90 degree turn in its fabrication. In this embodiment, the device of FIG. 1 or FIG. 2 can be used with this tape to accomplish the parallel orientations of the housing face and the card face. Alternatively, the 90 degree twist can be incorporated into the card holding means (42) rather than the tape end (40).

Other variations of material, manufacture and assembly are common in the art and are incorporated herein to other embodiments of the invention.

What is claimed is:

1. A retractable and self-orienting card holder comprising:

a) a housing and a circular cavity, having a broad-faced top and bottom, and a side with a tape-orienting slot therein;

b) a longitudinally flexible and laterally stiff tape coiled within the cavity and passing through said slot, said tape having a central end affixed within the housing and a peripheral end external to the housing, and said tape having a cross-sectional long and short axis and dimensioned to pass snugly through the slot;

c) a means for attaching a card to the peripheral tape end which maintains a fixed orientation of the card to the tape; and, d) a coil spring with a first end affixed to the housing a second end affixed to the tape such that the spring loads when the tape is withdrawn from the housing and dissipates as the tape withdraws into the housing.

2. The card holder of claim 1 in which the card face is held substantially parallel with the housing face.

3. The card holder of claim 2 in which the tape is twisted by a series of slots within the housing and exiting the housing with the long axis of the tape substantially parallel to the housing face.

4. A retractable and self-orienting card holder comprising:

a) a housing with a flat circular cavity, having a broad-faced top and bottom, and a side with a tape-orienting slot therein:

b) a circular rotatable spool fitted within the circular cavity, said spool having a circumference track and a central core adapted to accommodate a coiled spring;

c) a longitudinally flexible and laterally stiff tape coiled upon the track of the spool and passing through said slot, said tape having a central end affixed to the spool and a peripheral end external to the housing, said tape having a cross-sectional long and short axis and dimensioned to pass snugly through the slot;

d) a means for attaching a card to the peripheral tape end which maintains a fixed orientation of the card to the tape; and, e) a coil spring with first and second ends located within the central core of the spool, the first end affixed to the housing and the second end affixed to the spool such that the spring loads when the tape is withdrawn from the housing and dissipates as the tape withdraws into the housing.

5. The card holder of claim 4 in which the card face is held substantially parallel with the housing face.

6. The card holder of claim 5 in which the tape is twisted by a series of slots within the housing and exiting the housing with the long axis of the tape substantially parallel to the housing face.

* * * * *